US005412282A

United States Patent [19]

Kang

[11] Patent Number: 5,412,282

[45] Date of Patent: May 2, 1995

[54] RADIATION FIN STRUCTURE OF A MAGNETRON

[75] Inventor: Seong T. Kang, Buchun, Rep. of Korea

[73] Assignee: Goldstar Co., Ltd., Seoul, Rep. of Korea

[21] Appl. No.: 991,325

[22] Filed: Dec. 16, 1992

[30] Foreign Application Priority Data

Dec. 16, 1991 [KR] Rep. of Korea ..... 23085/1991

[51] Int. Cl.[6] ..... H01J 25/50; H01J 23/033

[52] U.S. Cl. ..... 315/39.51; 313/45

[58] Field of Search ..... 315/39.51; 313/40, 45

[56] References Cited

U.S. PATENT DOCUMENTS 3,667,154 6/1976 Tashiro et al. ..... 315/39.71
4,794,304 12/1988 Ito ..... 315/39.51

FOREIGN PATENT DOCUMENTS 201229 11/1983 Japan ..... 315/39.51
165334 9/1984 Japan ..... 315/39.51
165335 9/1984 Japan ..... 315/39.51
243639 10/1986 Japan ..... 315/39.51
93833 4/1987 Japan ..... 315/39.51
160634 7/1987 Japan ..... 315/39.51

*Primary Examiner*—Benny T. Lee
*Attorney, Agent, or Firm*—Fish & Richardson

[57] ABSTRACT

This invention relates to a radiation fin structure of a magnetron and a magnetron which includes such a structure. The fin structure is capable of effectively radiating heat at a high temperature produced during oscillation of the magnetron. The magnetron can be used to generate microwaves which can be emitted into a cavity of a microwave oven. The radiation fin is capable of reducing a separation region in the rear of an anode of the magnetron by guiding cold air which passes through a cooling section of the magnetron to the back side of the anode to generate turbulence within the cooling section. The radiation fin structure incorporated in this invention includes a plurality of pairs of confronting protrusions formed at opposite side portions of the radiation fin. The fins are arranged externally of the magnetron anode equally spaced-apart from one another to guide cold air to the back side of the anode.

12 Claims, 5 Drawing Sheets

RADIATION FIN STRUCTURE OF A MAGNETRON

BACKGROUND OF THE INVENTION

1. Field of the Invention

This invention relates to a radiation fin structure of a magnetron. The fin structure effectively radiates high temperature heat produced during oscillation of the magnetron as microwaves are generated.

2. Description of Related Art

Generally, a magnetron for generating microwaves, as shown in FIG. 1 of the accompanying drawings, is a type of diode which comprises an anode 1. The anode has a plurality of radially extending vanes 1*a* mounted on its inner periphery, and a direct-heated filament (referred to as a cathode) 4 disposed axially at its central position and surrounded by the anode.

In addition, the magnetron includes a magnetic circuit comprising upper and lower yokes 6*a*, 6*b*, upper and lower permanent magnets 7*a*, 7*b* attached to the lower surface of the upper yoke and the upper surface of the bottom of the lower yoke, respectively. Upper and lower magnetic poles 8*a*, 8*b*, act to apply a magnetic flux into an active space 5 defined between the anode 1 and the cathode 4. An output section, which is comprised of an antenna lead 9, an antenna seal 10, an antenna ceramic 11 and an antenna cap 12, emits microwave energy. The microwave energy is transferred from the anode 1 to the exterior of the magnetron, i.e., a cavity of a microwave oven, through a waveguide.

A plurality of a radiation fins 3 are parallel and vertically spaced-apart relative to one another, and are between the outer periphery of the cylindrical anode 1 and the inner periphery of the vertical wall of the lower yoke 6*b*. The radiation fins radiate heat at a high temperature, and the heat is generated from a collision between thermions, i.e. an electrically charged particle or ion emitted by a conducting material at high temperatures and the anode vanes 1*a*. There is disposed at an under side of the lower yoke a filter box 15 containing a choke coil 13 and a high voltage capacitor 14 which prevents unnecessary microwave components produced in the active space 5 from feeding back to the power source.

When cathode 4 is energized, thermions are emitted from the cathode into the active space 5 and effect cycloidal movement as they are subject to an electric field which is induced between the anode vanes 1*a* and the cathode 4. A magnetic flux is applied within the active space by magnetic poles 8*a*, 8*b* of the magnetic circuit. The thermions are accelerated and generate microwave energy which will be received by the anode vanes 1*a*.

When the thermions have reached the anode vanes, they retain the energy applied to them by the electric field. As a result, when they impinge against the anode vanes, the energy is converted into heat energy. In order to radiate the heat resulting from the impingement of the thermions against the vanes, the radiation fins 3, which are made of a heat conductive material of good quality, must be mounted externally of the anode 1.

In the past, in order to radiate heat of a high temperature generated during the oscillating operation of the magnetron, as shown in FIGS. 1 and 2, a plurality of plate type radiation fins 3 were fixedly mounted externally of the anode 1 in parallel, equally spaced-apart relation to one another. A blower fan (not shown) was mounted at one side of the electrical equipment chamber of the microwave oven to forcibly blow external cold air into the chamber. With this arrangement, when the external cold air is forcibly blown into the chamber by the fan, the blown air is guided to the yokes. The air then flows into the spaces between the radiation fins 3, thereby radiating heat from the fins.

When electric power is applied to the resonance section, i.e., the anode 1 of the magnetron, a given amount of microwave energy is produced within the section by movement of the thermions and transmitted to an output section. The remainder, which is referred to as anode loss, is converted into heat, and transferred to the fins 3, thereby being radiated to the exterior. Air which is blown by the fan flows between the spaced radiation fins 3 and between the lower yoke 6*b* (as shown in FIG. 2) and the radiation fins, thereby preventing a rise in temperature of the anode 1, or a lowering of the performance of the magnets 7*a*, 7*b* due to the temperature rise.

However, in the plate type radiation fins of the prior art which are generally equally spaced apart in relation to one another, as shown in FIG. 2, a separation phenomenon of an air stream occurs in the rear of the cylindrical anode 1 due to a difference in air pressure between the opposite sides and the back side of the anode. This takes place as the air passes through the gap between the adjacent fins 3 and around the cylindrical anode. The main stream of the cold air is excessively separated outwardly in the rear of the cylindrical anode by the separation phenomenon. As a result, since the cooling of the back side of the anode 1 by the main stream of the cold air is inferior to that of the front side, there is a great difference in temperature between the front and back sides. The output efficiency of the magnetron may be reduced and the thermal deformation of the vanes 1*a* due to the temperature difference at the anode may be increased, resulting in a shortening of the service life of the magnetron.

SUMMARY OF THE INVENTION

With the foregoing drawbacks of the prior art in view, the present invention provides a radiation fin structure of a magnetron, which is capable of reducing the separation region in the rear of a cylindrical anode of the magnetron by guiding the cold air passing through the cooling section of the magnetron to the back side of the anode, and at the same time forming turbulence within the cooling section.

According to one embodiment of the present invention, a radiation fin of a magnetron for radiating heat generated during oscillation of the magnetron, comprising means for positioning the fin about an anode of the magnetron and guide means for guiding cold air passing across the radiation fin to a back side of the anode is provided. In another embodiment of the invention, a magnetron which comprises a plurality of radiation fins positioned about an anode of the magnetron, each radiation fin comprising guide means for guiding cold air passing across the radiation fin to a back side of the anode is provided.

DESCRIPTION OF THE PREFERRED EMBODIMENT

The invention will now be described in detail, by way of example, with reference to FIGS. 3 through 6 of the accompanying drawings.

Figure 1:
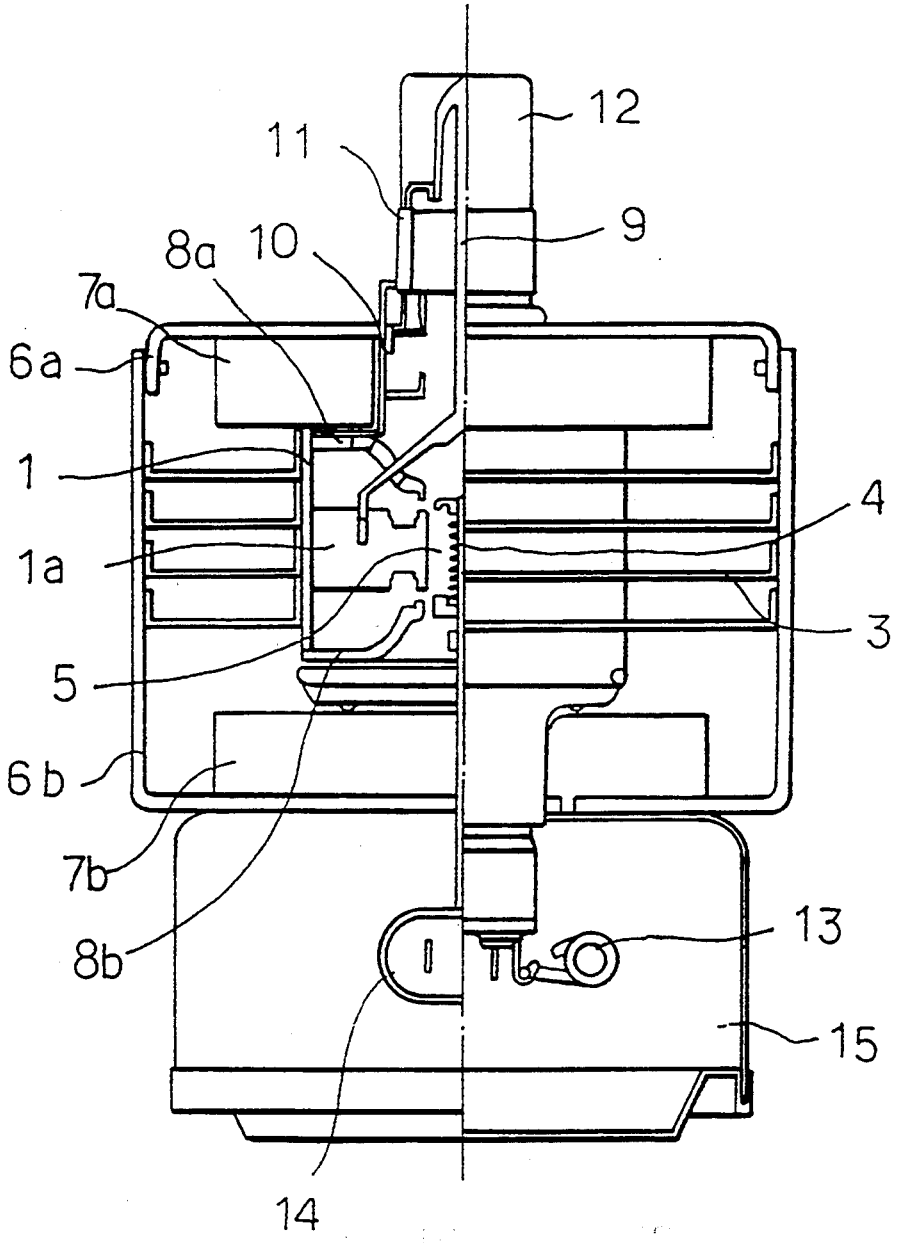
F I G. 1 PRIOR ART
FIG. 1 is a longitudinal cross-sectional view of a magnetron incorporating radiation fins according to the prior art.
Figure 2:
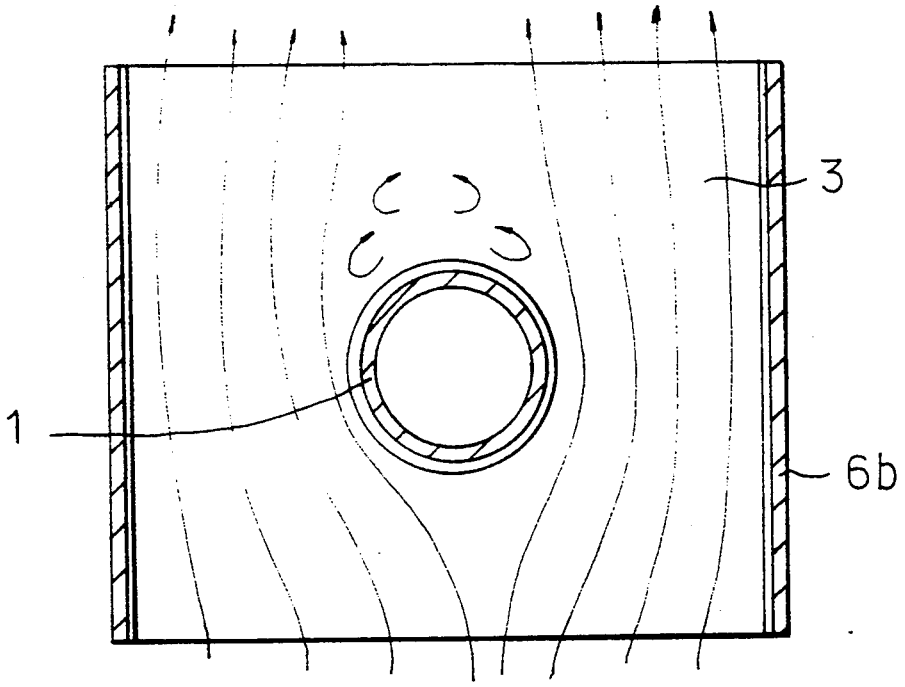
F I G.2 PRIOR ART
FIG. 2 is a transverse cross-sectional view showing the flow pattern of cold air across a prior art radiation fin.
Figure 3:
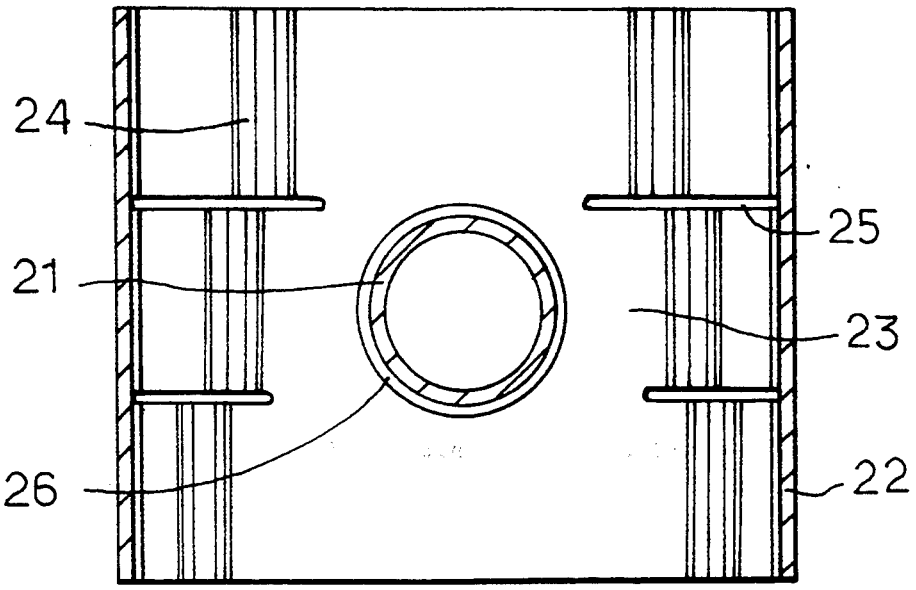
FIG. 3 is a transverse cross-sectional view of an anode section incorporating a radiation fin structure according to the present invention.
Figure 4:
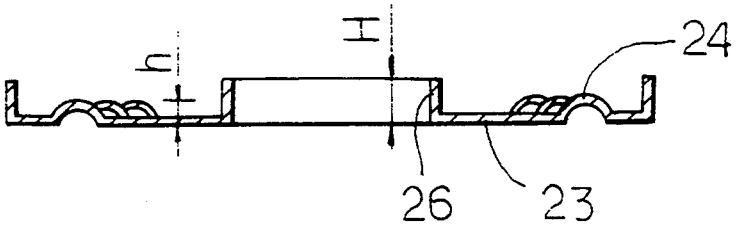
FIG. 4 is a vertical cross-sectional view of the radiation fin shown FIG. 3.

Referring to FIGS. 3 and 4, showing transverse and vertical sectional views of a radiation fin according to one embodiment of the present invention, the radiation fin structure of the present invention is identical to that of the prior art in that a plurality of equally spaced radiation fins are disposed externally of an cylindrical anode to radiate heat generated at the anode. According to the novel and improved features of the present invention, however, the radiation fin 23 is provided with guide means for guiding cold air blown forcibly by a blower fan (not shown) to the back side of the anode 21 (see FIG. 3).

The guide means comprises a plurality of pairs of confronting protrusions 24 of a semi-circular cross-sectional configuration formed at the opposite side portions of each radiation fin 23 by a press work. The protrusions are arranged at distances which are decreased gradually from the widest distance at a cold air inlet side of the fin, as shown in FIG. 3. In addition, in order to prevent mutual interference between the protrusions 24 occurring during the press work, i.e., to prevent defects, a slit 25 (see FIG. 3) is formed between adjacent protrusions. Boss 26 and yoke 22 are also provided.

Further, as shown in FIG. 4, a height "h" of each protrusion 24 on the radiation fin 23 is preferably less than the height "H" of a boss 26 which engages with the anode 21 (see FIG. 3). The reasons for this is to prevent protrusions 24 from interfering with the adjacent radiation fin 23 when the fins have been assembled.

Figure 6A:
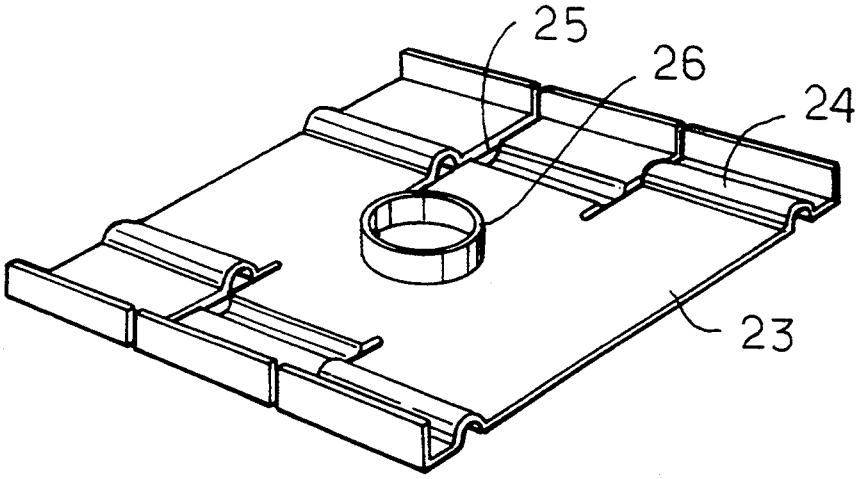
FIGS. 6*a*, 6*b*, and 6*c* are perspective views showing various embodiments of the present invention.
Figure 6B:
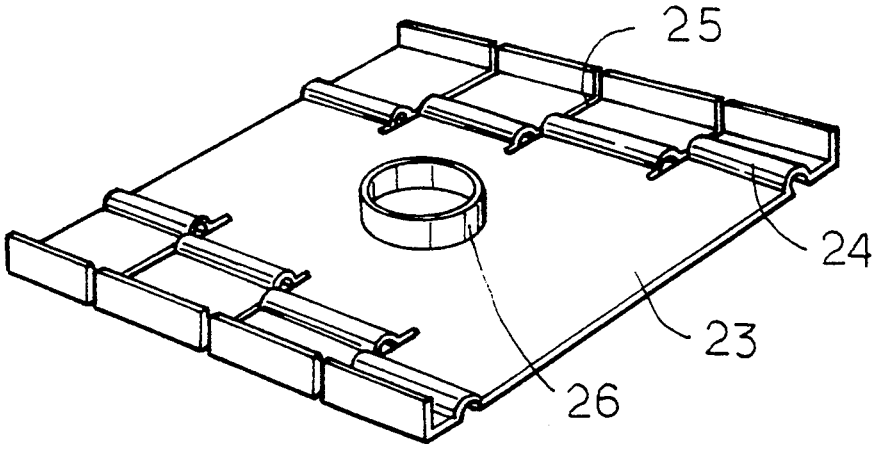
Figure 6C:
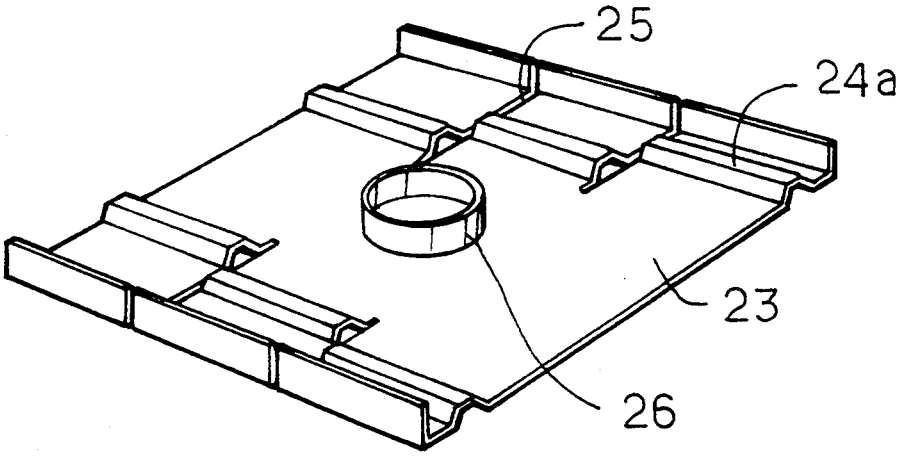

In the embodiment shown in FIGS. 3 and 4, three semi-circular protrusions 24 project in the same direction at each side portion of the radiation fin. The protrusions 24 may project alternately in upward and downward directions, however, as shown in FIG. 6*a*. Alternatively, four or more protrusions 24 may project in the same direction, as shown in FIG. 6*b*. Further, as shown in FIG. 6*c*, the protrusions 24*a* can be of a polygonal shape. Other shapes, for example, a trapezoid, may be formed.

Figure 5A:
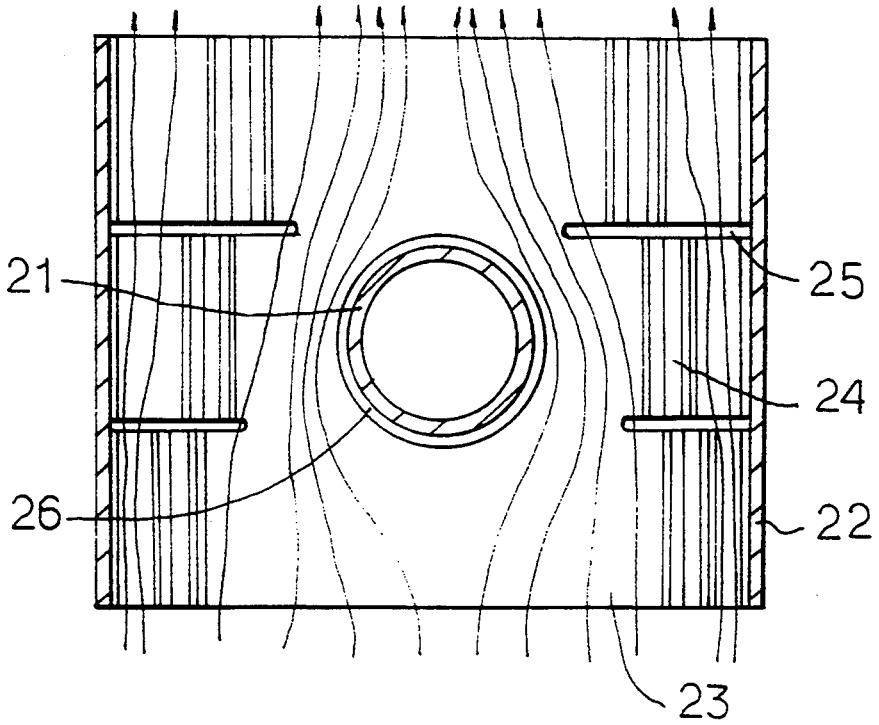
FIGS. 5*a* and 5*b* are transverse cross-sectional and side views showing the flow pattern of cold air across the radiation fin according to the present invention.
Figure 5B:
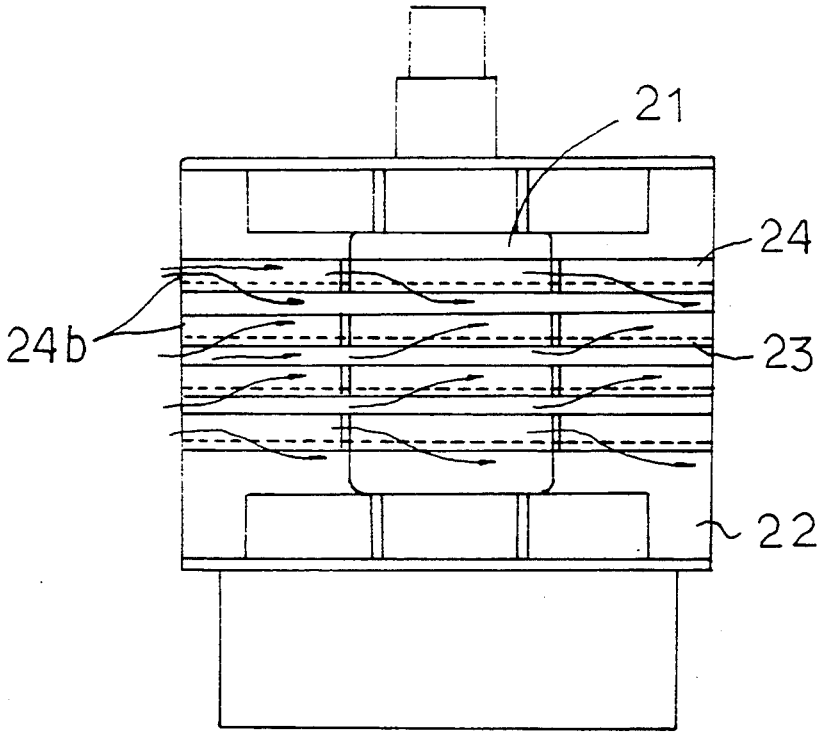

The operation of the present invention will now be explained in conjunction with FIGS. 5*a* and 5*b*.

When external cold air is forcibly blown into the space between yokes 22 by the blower fan to radiate heat generated at the anode 21, which is engaged with a boss 26, during operation of the magnetron, the blown cold air impinges against the side walls of each protrusion 24. The air is then deflected and passes by opposite sides of each protrusion in the direction of the arrows as shown in FIGS. 5*a* and 5*b*. The arrangement of the pairs of confronting protrusions 24, which are arranged at distances decreasing gradually from the widest distance at the cold air inlet side, are positioned such that the deflected main stream of the cold air is urged to the back side of the anode 21. This considerably reduces the separation region of the main stream resulting in enhanced cooling at the back of the anode by the main stream of the cold air.

A violent turbulence is produced as the cold air flows alternately above and below the radiation fin 23 and through the concave portions 24*b* (see FIG. 5*b*) of the protrusions 24, thereby violently pulsating between the plurality of radiation fins. As a result, friction between the cold air and the fins is increased, thereby further enhancing the cooling effect.

During operation, a plurality of the radiation fins 23, which are disposed externally of the anode 21 in a stacked array, shown in FIGS. 6*a* and 6*b*, provides the same cooling effect as the fins of the first embodiment of the present invention. These radiation fins include slits 25, boss 26, and protrusions 24. Further, the protrusions 24*a*, which are a polygonal shape as shown in FIG. 6*c*, may increase the radiation area of each radiation fin 23 in the yoke 22 (not shown) of the same size, thereby providing a further enhanced cooling effect. This radiation fin includes slits 25 and boss 26.

From the foregoing it will be appreciated that the present invention provides an efficient radiation fin structure of a simple construction. The fin structure includes a plurality of pairs of protrusions which can be of a semi-circular or polygonal shape, and are formed at opposite side portions of each radiation fin 23. The protrusions are arranged at distances which decrease gradually from the widest distance at the cold air inlet side. This allows cold air which is introduced into the yokes to be guided to the back side of the anode 21. The structure causes the air to pulsate, creating turbulent air flow. The turbulent air flow reduces the difference in temperature between the front and back sides of the anode, resulting in an enhanced output efficiency and an extended service life of the magnetron.

While the invention has been shown and described with reference to various embodiments thereof, it will be understood that variations and modifications in form and detail may be made therein without departing from the spirit and scope of the invention as defined in the appended claims.

What is claimed is:

1. A radiation fin for a magnetron, said radiation fin for radiating heat generated during oscillation of the magnetron, said radiation fin comprising:

means for positioning said radiation fin about an anode of the magnetron, said anode having front and back sides;

a cold air inlet side disposed at said front side said anode; and guide means for guiding a flow of cold air passing across said radiation fin from said front side to said back side of said anode, said guide means comprising:

a plurality of pairs of confronting protrusions disposed at opposite side portions of said radiation fin, each of said protrusions having an elongated shape extending in a direction aligned with the flow of said cold air across said radiation fin, each said pair of confronting protrusions having a respective distance therebetween, said plurality of pairs of confronting protrusions arranged such that distances between successive pairs of confronting protrusions gradually decrease in the direction from said cold air inlet side disposed at said front side of said anode of said fin to said back side of said anode, and said pairs of confronting protrusions disposed along a substantial portion of an entire length of said radiation fin aligned along the direction of the flow of cold air.

2. A radiation fin for a magnetron as claimed in claim 1, wherein protrusions at each opposite side portion of said radiation fin project alternately in upward and downward directions.

3. A radiation fin for a magnetron as claimed in claim 1, wherein a respective slit is disposed between protrusions which are adjacent to one another.

4. A radiation fin for a magnetron as claimed in claim 1, wherein protrusions at each opposite side portion of said radiation fin project uniformly in a common direction.

5. A radiation fin for a magnetron as claimed in claim 1, wherein each protrusion has a semi-circular cross-sectional configuration.

6. A radiation fin for a magnetron as claimed in claim 1, wherein each protrusion has a trapezoid cross-sectional configuration.

7. A magnetron including a cathode, an anode, resonant cavities, and output coupling operatively connected together, said magnetron comprising:

a plurality of radiation fins positioned about the anode of the magnetron, said anode having front and back sides, each of said radiation fins having a cold air inlet side disposed at said front side of said anode, each of said radiation fins comprising guide means for guiding a flow of cold air passing across the radiation fin from said front side to said back side of said anode, said guide means comprising a plurality of pairs of confronting protrusions disposed at opposite side portions of the radiation fin, each of said protrusions having an elongated shape extending in a direction aligned with the flow of said cold air across said radiation fin, each said pair of confronting protrusions having a respective distance therebetween, wherein said plurality of pairs of confronting protrusions are arranged such that distances between successive pairs of confronting protrusions gradually decrease in a direction from said cold air inlet side disposed at said front side of said anode of said fin to said back side of said anode, and wherein said pairs of confronting protrusions are disposed along a substantial portion of an entire length of said radiation fin aligned along the direction of the flow of air.

8. A magnetron as claimed in claim 7, wherein a respective slit is disposed between protrusions which are adjacent to one another.

9. A magnetron as claimed in claim 7, wherein protrusions at each opposite side portion of said radiation fin project uniformly in a common direction.

10. A magnetron as claimed in claim 7, wherein each protrusion has a semi-circular cross-sectional configuration.

11. A magnetron as claimed in claim 7, wherein each protrusion has a trapezoid cross-sectional configuration.

12. A magnetron as claimed in claim 7, wherein protrusions at each opposite side portion of said radiation fin project alternately in upward and downward directions.

* * * * *